US010082049B2

(12) United States Patent
Lee et al.

(10) Patent No.: US 10,082,049 B2
(45) Date of Patent: Sep. 25, 2018

(54) SUPERCRITICAL CARBON DIOXIDE POWER GENERATION SYSTEM

(71) Applicant: Korea Institute of Energy Research, Daejeon (KR)

(72) Inventors: Gil Bong Lee, Seoul (KR); Young Jin Baik, Daejeon (KR); Jun Hyun Cho, Daejeon (KR); Ho Sang Ra, Daejeon (KR); Hyung Ki Shin, Daejeon (KR)

(73) Assignee: Korea Institute of Energy Research, Daejeon (KR)

( * ) Notice: Subject to any disclaimer, the term of this patent is extended or adjusted under 35 U.S.C. 154(b) by 291 days.

(21) Appl. No.: 15/186,876

(22) Filed: Jun. 20, 2016

(65) Prior Publication Data

US 2016/0369658 A1 Dec. 22, 2016

(30) Foreign Application Priority Data

Jun. 18, 2015 (KR) ..... 10-2015-0086476

(51) Int. Cl.

| | |
|---|---|
| ***F01K 25/10*** | (2006.01) |
| ***F01K 7/32*** | (2006.01) |
| ***F01K 7/16*** | (2006.01) |
| ***F01K 19/04*** | (2006.01) |

(52) U.S. Cl.

CPC ..... *F01K 25/103* (2013.01); *F01K 7/16* (2013.01); *F01K 7/32* (2013.01); *F01K 19/04* (2013.01)

(58) Field of Classification Search

CPC ..... F01K 19/04; F01K 25/103; F01K 7/16; F01K 7/32

See application file for complete search history.

(56) References Cited

U.S. PATENT DOCUMENTS

| | | | | |
|---|---|---|---|---|
| 4,248,049 | A * | 2/1981 | Briley | F24D 11/0221 62/235.1 |
| 5,647,221 | A * | 7/1997 | Garris, Jr. | F04F 5/18 417/179 |
| 5,754,613 | A * | 5/1998 | Hashiguchi | F01K 23/04 376/378 |
| 9,926,814 | B2 * | 3/2018 | Roh | F01K 25/103 |
| 2012/0128463 | A1 * | 5/2012 | Held | F01K 23/10 415/1 |
| 2014/0102101 | A1 | 4/2014 | Xie et al. | |
| 2014/0103661 | A1 | 4/2014 | Kacludis et al. | |

OTHER PUBLICATIONS

"A supercritical or transcritical Rankine cycle with ejector using low-grade heat." Energy Conversion and Management, vol. 78, Feb. 2014, pp. 551-558 (Abstract).

* cited by examiner

*Primary Examiner* — Laert Dounis
*Assistant Examiner* — Matthew T Largi
(74) *Attorney, Agent, or Firm* — Dorsey & Whitney LLP

(57) ABSTRACT

A supercritical carbon dioxide power generation system is provided. The supercritical carbon dioxide power generation system may include a regenerator, a turbine, a heat recoverer, a condenser, a compressor an expansion valve, a flash tank, a heat exchanger, and an ejector, and may utilize waste heat of the supercritical carbon dioxide power generation system.

10 Claims, 2 Drawing Sheets

SUPERCRITICAL CARBON DIOXIDE POWER GENERATION SYSTEM

CROSS-REFERENCE TO RELATED APPLICATION

This application claims the benefit of Korean Patent Application No. 10-2015-0086476, filed on 18 Jun. 2015, in the Korean Intellectual Property Office, the disclosure of which is incorporated herein by reference.

BACKGROUND

1. Field of the Invention

Embodiments relate to a supercritical carbon dioxide power generation system.

2. Description of the Related Art

An interest in improvement of a high-efficiency power generation technology for enhancing availability of an existing energy source continues to increase. Research and development of a supercritical carbon dioxide power generation technology as an alternative to improve the high-efficiency power generation technology are being actively conducted.

The supercritical carbon dioxide power generation technology is a Brayton cycle-based power generation technology of driving a turbine by heating carbon dioxide compressed at an ultra high pressure equal to or greater than a critical pressure. The supercritical carbon dioxide power generation technology is applicable to various heat sources, for example, nuclear energy, thermal power, solar heat, geothermal energy, and the like, and has advantages of compactness and high efficiency.

A typical supercritical carbon dioxide power generation system includes a regenerator configured to heat supercritical carbon dioxide as working fluid to a target maximum temperature, a turbine driven by high-temperature and high-pressure supercritical carbon dioxide, a cooler or a condenser configured to lower the temperature of low-pressure supercritical carbon dioxide, a compressor configured to pressurize low-temperature and low-pressure supercritical carbon dioxide, and a heat recoverer configured to heat low-temperature supercritical carbon dioxide using high-temperature supercritical carbon dioxide. However, utilization of waste heat of high-temperature exhaust gas emitted from the regenerator is low. Also, a compression efficiency is decreased in a supercritical carbon dioxide cycle, or making it difficult to efficiently use energy.

SUMMARY

Embodiments provide a supercritical carbon dioxide power generation system that may increase utilization of waste heat generated in a regenerator and may provide an efficient supercritical carbon dioxide cycle by exchanging heat for each interval of the supercritical carbon dioxide cycle.

Problems to be solved by the embodiments in the present disclosure are not limited to the foregoing problems, and other problems not mentioned herein would be clearly understood by one of ordinary skill in the art from the following description.

According to an aspect, there is provided a supercritical carbon dioxide power generation system including a regenerator configured to heat supercritical carbon dioxide, a turbine driven by the supercritical carbon dioxide heated by the regenerator, a heat recoverer configured to recover heat of the supercritical carbon dioxide discharged from the turbine and to heat supercritical carbon dioxide that flows into the regenerator, a condenser configured to cool the supercritical carbon dioxide passing through the heat recoverer, a compressor configured to pressurize and compress the supercritical carbon dioxide discharged from the condenser, an expansion valve configured to expand at least a portion of the supercritical carbon dioxide discharged from the condenser, a flash tank configured to separate the expanded supercritical carbon dioxide into liquid and gas, a heat exchanger configured to exchange heat between the gas and at least a portion of the supercritical carbon dioxide discharged from the condenser, the heat exchanger being placed between the condenser and the compressor, and an ejector configured to recover the gas passing through the heat exchanger and to move the gas to the condenser.

The liquid may flow into the compressor.

The supercritical carbon dioxide discharged from the condenser may have a quality equal to or greater than "0.5."

The supercritical carbon dioxide power generation system may further include an ejector regenerator configured to recover heat from the regenerator and to heat at least a portion of the supercritical carbon dioxide discharged from the compressor.

The supercritical carbon dioxide heated by the ejector regenerator may flow into the condenser through the ejector.

According to another aspect, there is provided a supercritical carbon dioxide power generation system including a regenerator configured to heat supercritical carbon dioxide, a turbine driven by the supercritical carbon dioxide heated by the regenerator, a heat recoverer configured to recover heat of the supercritical carbon dioxide discharged from the turbine and to heat supercritical carbon dioxide that flows into the regenerator, a condenser configured to cool the supercritical carbon dioxide passing through the heat recoverer, a compressor configured to pressurize and compress the supercritical carbon dioxide discharged from the condenser, a first expansion valve configured to expand, in a first stage, at least a portion of the supercritical carbon dioxide discharged from the condenser, a second expansion valve configured to expand, in a second stage, the portion of the supercritical carbon dioxide expanded in the first stage, a first heat exchanger configured to exchange heat between the supercritical carbon dioxide expanded in the first stage and the supercritical carbon dioxide expanded in the second stage, a second heat exchanger configured to exchange heat between at least a portion of the supercritical carbon dioxide discharged from the condenser and the supercritical carbon dioxide that is expanded in the second stage and that is discharged from the first heat exchanger, the second heat exchanger being placed between the condenser and the compressor, and an ejector configured to recover the supercritical carbon dioxide that is expanded in the second stage and that passes through the second heat exchanger, and to move the supercritical carbon dioxide to the condenser.

The supercritical carbon dioxide that is expanded in the first stage and that is discharged from the first heat exchanger may flow into the compressor.

The supercritical carbon dioxide discharged from the condenser may have a quality less than "0.5."

The supercritical carbon dioxide power generation system may further include an ejector regenerator configured to recover heat from the regenerator and to heat at least a portion of the supercritical carbon dioxide discharged from the compressor.

The supercritical carbon dioxide heated by the ejector regenerator may flow into the condenser through the ejector.

Effect

According to embodiments, it is possible to provide an efficient supercritical carbon dioxide cycle by exchanging heat for each interval of the supercritical carbon dioxide cycle.

In addition, according to embodiments, by exchanging heat for each interval of a supercritical carbon dioxide cycle, it is possible to increase a compressor efficiency of supercritical carbon dioxide in a supercritical carbon dioxide power generation system, and possible to reduce energy consumption in the supercritical carbon dioxide cycle.

Furthermore, according to embodiments, heat wasted during heating of a regenerator (for example, a heater) may be reused, and thus it is possible to enhance an energy efficiency of a supercritical carbon dioxide power generation system.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Figure 1:
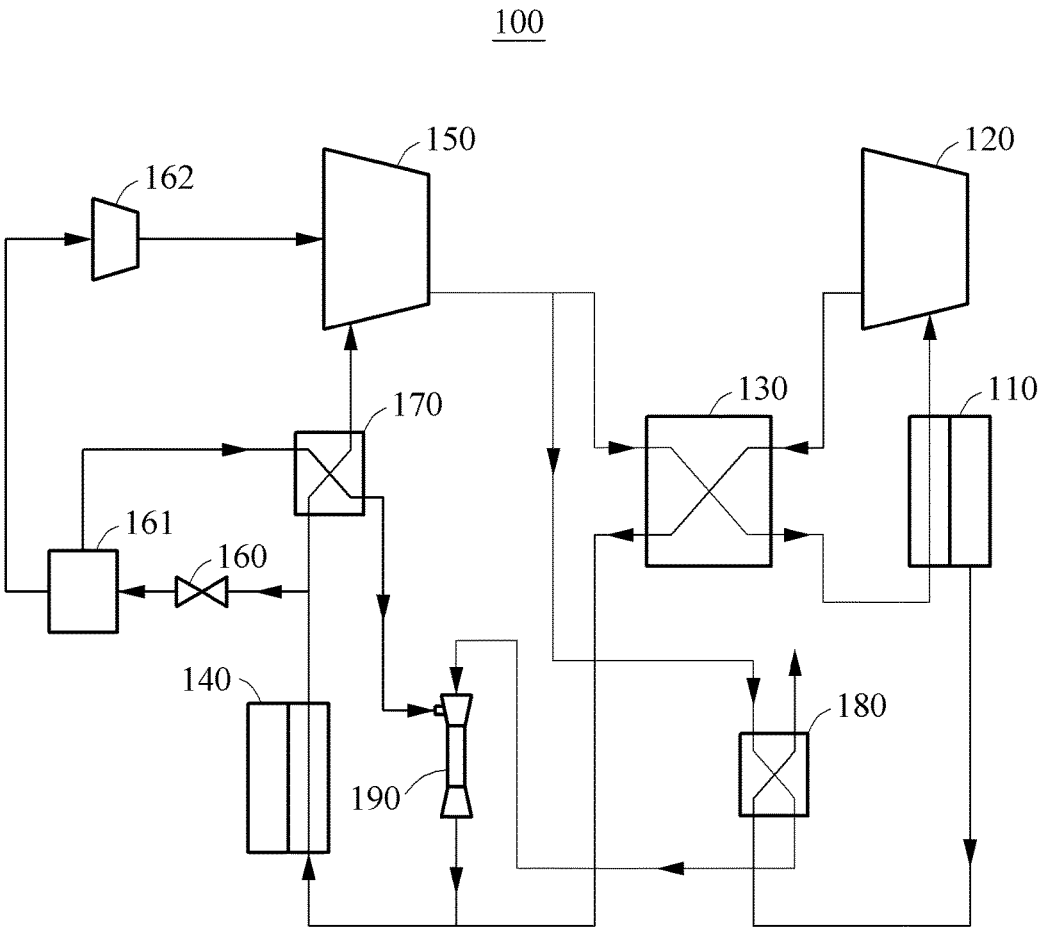
FIG. 1 is a diagram illustrating an example of a configuration of a supercritical carbon dioxide power generation system according to an embodiment.

Hereinafter, embodiments of the present disclosure will be further described with reference to the accompanying drawings. When it is determined detailed description related to a related known function or configuration they may make the purpose of the present disclosure unnecessarily ambiguous in describing the present disclosure, the detailed description will be omitted here. Also, terminologies used herein are defined to appropriately describe the embodiments and thus may be changed depending on a user, the intent of an operator, or a custom of a field to which the present disclosure pertains. Accordingly, the terminologies must be defined based on the following overall description of this specification. Like reference numerals illustrated in the drawings refer to like constituent elements throughout the specification.

The following embodiments relate to a supercritical carbon dioxide power generation system.

Hereinafter, an example of a supercritical carbon dioxide power generation system according to an embodiment is described with reference to FIG. 1.

FIG. 1 illustrates a configuration of a supercritical carbon dioxide power generation system 100 according to an embodiment. Referring to FIG. 1, the supercritical carbon dioxide power generation system 100 includes a regenerator 110, a turbine 120, a heat recoverer 130, a condenser 140, a compressor 150, an expansion valve 160, a flash tank 161, a heat exchanger 170, an ejector regenerator 180, and an ejector 190. The supercritical carbon dioxide power generation system 100 further includes a pump 162. In the present disclosure, an ejector regenerator may be referred to as a "secondary regenerator."

The regenerator 110 may heat supercritical carbon dioxide by receiving heat from an external heat source. In one side of the regenerator 110, a flow path connecting the regenerator 110 and the ejector regenerator 180 is disposed to allow high-temperature exhaust gas generated during the heating to flow to the ejector regenerator 180. In another side of the regenerator 110, a flow path connecting the compressor 150 and the turbine 120 is disposed to allow the heated supercritical carbon dioxide to flow to the turbine 120.

The turbine 120 may receive the supercritical carbon dioxide heated to be equal to or higher than a critical temperature from the regenerator 110, and may be driven through an expansion process, to generate work.

The heat recoverer 130 may be referred to as a "recuperator" or a "heat regenerator," and may recover heat of the supercritical carbon dioxide discharged from the turbine 120 and may heat supercritical carbon dioxide that flows into the regenerator 110. A flow path connecting the turbine 120 and the condenser 140 and the flow path connecting the compressor 150 and the turbine 120 are disposed in heat recoverer 130.

The condenser 140 may cool the supercritical carbon dioxide passing through the heat recoverer 130 along the flow path connecting the turbine 120 and the condenser 140. The condenser 140 is connected to a flow path connecting the condenser 140 and the compressor 150 and a flow path connecting the condenser 140 and the flash tank 161. The supercritical carbon dioxide discharged from the condenser 140 may have a quality equal to or greater than "0.5."

The compressor 150 may pressurize and compress low-pressure supercritical carbon dioxide discharged from the condenser 140. For example, the compressor 150 may pressurize and compress at least a portion of the low-pressure supercritical carbon dioxide discharged from the condenser 140 and at least a portion of supercritical carbon dioxide discharged from the flash tank 161. The compressor 150 is connected to the flow path connecting the compressor 150 and the turbine 120 and a flow path connecting the compressor 150 and the ejector 190.

The expansion valve 160 is disposed in the flow path connecting the condenser 140 and the flash tank 161. The expansion valve 160 may expand at least a portion of the supercritical carbon dioxide discharged from the condenser 140, and may allow the expanded supercritical carbon dioxide to flow into the flash tank 161.

The flash tank 161 may separate the supercritical carbon dioxide expanded by the expansion valve 160 into liquid and gas. The flash tank 161 may selectively separate the liquid from the gas, and may reduce an amount of energy to be consumed when the separated liquid is compressed by the compressor 150.

A flow path connecting the flash tank 161 and the compressor 150 is disposed in one side of the flash tank 161, and a flow path connecting the flash tank 161 and the ejector 190 is disposed in another side of the flash tank 161, and accordingly supercritical carbon dioxide discharged from the flash tank 161 may flow into the compressor 150 and the ejector 190. For example, the liquid and the gas into which the supercritical carbon dioxide is separated by the flash tank 161 may flow into the compressor 150 and the ejector 190, respectively.

The pump 162 is disposed in the flow path connecting the flash tank 161 and the compressor 150, and may apply a pressure to the supercritical carbon dioxide discharged from the flash tank 161 to allow the supercritical carbon dioxide to flow into the compressor 150.

The heat exchanger 170 is disposed between the condenser 140 and the compressor 150, and may exchange heat between the supercritical carbon dioxide discharged from the flash tank 161 and the supercritical carbon dioxide discharged from the condenser 140. In the heat exchanger 170, the flow path connecting the flash tank 161 and the ejector 190 and the flow path connecting the condenser 140 and the compressor 150 are disposed in the heat exchanger 170.

The ejector regenerator 180 may exchange heat between at least a portion of the supercritical carbon dioxide discharged from the compressor 150 and the high-temperature exhaust gas discharged from the regenerator 110. When the heat is exchanged by the ejector regenerator 180, the supercritical carbon dioxide may flow into the ejector 190, and the exhaust gas may be discharged from the supercritical carbon dioxide power generation system 100. The flow path connecting the compressor 150 and the ejector 190 and the flow path connecting the regenerator 110 and the ejector regenerator 180 are disposed in the ejector regenerator 180.

The ejector 190 may recover low-pressure supercritical carbon dioxide that is expanded and heat-exchanged by passing through the heat exchanger 170 and high-pressure supercritical carbon dioxide that is heat-exchanged by passing through the ejector regenerator 180, and may allow the low-pressure supercritical carbon dioxide and the high-pressure supercritical carbon dioxide to flow into the condenser 140.

Hereinafter, an operation of the supercritical carbon dioxide power generation system 100 will be described.

Supercritical carbon dioxide may be heated by the regenerator 110 using an external heat source to a temperature and a pressure equal to or higher than a critical temperature and a critical pressure. The heated supercritical carbon dioxide may be supplied to the turbine 120, and high-temperature exhaust gas may flow into the ejector regenerator 180.

The turbine 120 may be driven by the supercritical carbon dioxide, to generate work.

The supercritical carbon dioxide discharged from the turbine 120 may be cooled by losing heat to low-temperature and high-pressure supercritical carbon dioxide discharged from the compressor 150 while passing through the heat recoverer 130, and the cooled supercritical carbon dioxide may flow into the condenser 140. The heated supercritical carbon dioxide may flow into the regenerator 110 and may be heated to be equal to or higher than the critical temperature and the critical pressure.

The supercritical carbon dioxide flowing into the condenser 140 may be cooled. A portion of low-temperature and low-pressure supercritical carbon dioxide discharged from the condenser 140 may flow into the compressor 150 by passing through the heat exchanger 170, and the other portion may be expanded by the expansion valve 160.

The supercritical carbon dioxide expanded by the expansion valve 160 may flow into the flash tank 161 and may be separated into liquid and gas in the flash tank 161, and the liquid and the gas may flow into the compressor 150 and the ejector 190, respectively. For example, the liquid may flow into the compressor 150 through the flow path connecting the flash tank 161 and the compressor 150, or through the pump 162 disposed in the flow path connecting the flash tank 161 and the compressor 150.

The gas may cool the supercritical carbon dioxide discharged from the condenser 140 while passing through the heat exchanger 170 along the flow path connecting the flash tank 161 and the ejector 190, and may flow into the ejector 190. The cooled supercritical carbon dioxide may flow into the compressor 150.

The supercritical carbon dioxide flowing into the compressor 150 may be pressurized and compressed. At least a portion of high-pressure supercritical carbon dioxide discharged from the compressor 150 may be heated by passing through the heat recoverer 130, and may flow into the regenerator 110. The other portion may be heated by exhaust gas by passing through the ejector regenerator 180, and may flow into the ejector 190. The exhaust gas may be discharged from the supercritical carbon dioxide power generation system 100.

Low-pressure supercritical carbon dioxide and high-pressure supercritical carbon dioxide may flow into the condenser 140 through the ejector 190, and may be cooled in the condenser 140.

As described above, supercritical carbon dioxide may be heated using the exhaust gas generated in the regenerator 110, and thus it is possible to utilize waste heat of the supercritical carbon dioxide power generation system 100. Also, a portion of supercritical carbon dioxide discharged from the condenser 140 may be expanded and utilized to cool supercritical carbon dioxide that is to flow into the compressor 150, and the other potion may flow into the compressor 150 and may be compressed, and thus it is possible to enhance an efficiency of a supercritical carbon dioxide cycle in the supercritical carbon dioxide power generation system 100. The supercritical carbon dioxide cooled by the expanded supercritical carbon dioxide may flow into the compressor 150, and thus it is possible to enhance a compression efficiency of the compressor 150 and to reduce energy consumption in the supercritical carbon dioxide cycle.

Hereinafter, another example of a supercritical carbon dioxide power generation system according to an embodiment is described with reference to FIG. 2.

Figure 2:
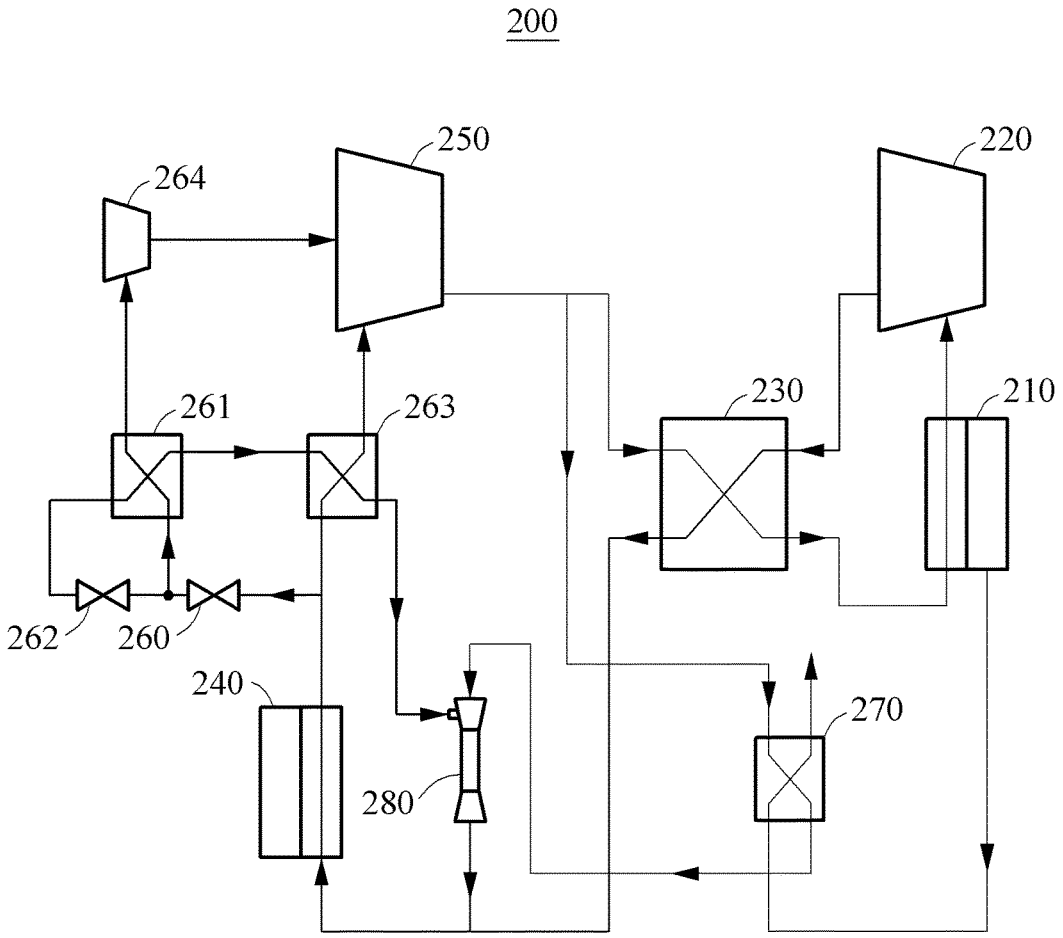
FIG. 2 is a diagram illustrating another example of a configuration of a supercritical carbon dioxide power generation system according to an embodiment.

FIG. 2 illustrates a configuration of a supercritical carbon dioxide power generation system 200 according to an embodiment. Referring to FIG. 2, the supercritical carbon dioxide power generation system 200 includes a regenerator 210, a turbine 220, a heat recoverer 230, a condenser 240, a compressor 250, a first expansion valve 260, a first heat exchanger 261, a second expansion valve 262, a second heat exchanger 263, an ejector regenerator 270, and an ejector 280. The supercritical carbon dioxide power generation system 200 further includes a pump 264.

The regenerator 210, the turbine 220, the heat recoverer 230, the condenser 240, the compressor 250 and the ejector regenerator 270 may correspond to the regenerator 110, the turbine 120, the heat recoverer 130, the condenser 140, the compressor 150 and the ejector regenerator 180 of FIG. 1, respectively.

The regenerator 210 may correspond to the regenerator 110 of FIG. 1. In one side of the regenerator 210, a flow path connecting the regenerator 210 and the ejector regenerator 270 is disposed to allow high-temperature exhaust gas generated during heating of supercritical carbon dioxide to flow to the ejector regenerator 270. In another side of the regenerator 210, a flow path connecting the compressor 250 and the turbine 220 is disposed to allow heated supercritical carbon dioxide to flow to the turbine 220.

The heat recoverer 230 may correspond to the heat recoverer 130 of FIG. 1. A flow path connecting the turbine 220 and the condenser 240 and the flow path connecting the compressor 250 and the turbine 220 are disposed in the heat recoverer 230.

The condenser 240 may correspond to the condenser 140 of FIG. 1. The condenser 240 is connected to a flow path connecting the condenser 240 and the compressor 250 and a flow path connecting the condenser 240 and the first expansion valve 260. Supercritical carbon dioxide discharged from the condenser 240 may have a quality less than "0.5."

The compressor 250 may correspond to the condenser 150 of FIG. 1. The compressor 250 may pressurize and compress at least a portion of low-pressure supercritical carbon dioxide discharged from the condenser 240 and at least a portion of supercritical carbon dioxide expanded by the first expansion valve 260. The compressor 250 is connected to the flow path connecting the compressor 250 and the turbine 220 and a flow path connecting the compressor 250 and the ejector 280.

The first expansion valve 260 may expand, in a first stage, at least a portion of the supercritical carbon dioxide discharged from the condenser 240. The first expansion valve 260 is connected to a flow path connecting the first expansion valve 260 and the compressor 250 and a flow path connecting the first expansion valve 260 and the second expansion valve 262.

In the first heat exchanger 261, the flow path connecting the first expansion valve 260 and the compressor 250 and a flow path connecting the second expansion valve 262 and the ejector 280 are disposed. The first heat exchanger 261 may exchange heat between the supercritical carbon dioxide expanded in the first stage and supercritical carbon dioxide expanded in a second stage.

The second expansion valve 262 may expand, in the second stage, at least a portion of the supercritical carbon dioxide expanded in the first stage by the first expansion valve 260. The second expansion valve 262 is connected to the flow path connecting the second expansion valve 262 and the ejector 280.

The second heat exchanger 263 is disposed between the condenser 240 and the compressor 250, and the flow path connecting the condenser 240 and the compressor 250 and the flow path connecting the second expansion valve 262 and the ejector 280 are disposed. The second heat exchanger 263 may exchange heat between supercritical carbon dioxide that is heat-exchanged by passing through the first heat exchanger 261 along the flow path connecting the second expansion valve 262 and the ejector 280 and supercritical carbon dioxide that flows through the flow path connecting the condenser 240 and the compressor 250.

The ejector 280 may recover low-pressure supercritical carbon dioxide that is heat-exchanged by the second heat exchanger 263 through the flow path connecting the second expansion valve 262 and the ejector 280, and high-pressure supercritical carbon dioxide that is heat-exchanged by the ejector regenerator 270, and may allow the low-pressure supercritical carbon dioxide and the high-pressure supercritical carbon dioxide to flow into the condenser 240.

The ejector regenerator 270 may correspond to the ejector regenerator 180 of FIG. 1. In the ejector regenerator 270, a flow path connecting the compressor 250 and the ejector 280 and a flow path connecting the regenerator 210 and the ejector regenerator 270 are disposed.

The pump 264 is disposed in the flow path connecting the first expansion valve 260 and the compressor 250, may apply a pressure to the supercritical carbon dioxide discharged from the first heat exchanger 261 to allow the supercritical carbon dioxide to flow into the compressor 250.

Hereinafter, an operation of the supercritical carbon dioxide power generation system 200 will be described.

Supercritical carbon dioxide may be heated by the regenerator 210 using an external heat source to a temperature and a pressure equal to or higher than a critical temperature and a critical pressure. The heated supercritical carbon dioxide may be supplied to the turbine 220, and high-temperature exhaust gas may flow into the ejector regenerator 270.

The turbine 220 may be driven by the supercritical carbon dioxide, to generate work.

The supercritical carbon dioxide discharged from the turbine 220 may be cooled by losing heat to low-temperature and high-pressure supercritical carbon dioxide discharged from the compressor 250 while passing through the heat recoverer 230, and the cooled supercritical carbon dioxide may flow into the condenser 240. The heated supercritical carbon dioxide may flow into the regenerator 210 and may be heated to be equal to or higher than the critical temperature and the critical pressure.

At least a portion of high-pressure supercritical carbon dioxide discharged from the compressor 250 may flow into the ejector regenerator 270 and may be heated by exhaust gas, and the heated supercritical carbon dioxide may flow into the ejector 280. The exhaust gas may be discharged from the supercritical carbon dioxide power generation system 200.

The supercritical carbon dioxide flowing into the condenser 240 may be cooled. A portion of low-temperature and low-pressure supercritical carbon dioxide discharged from the condenser 240 may flow into the compressor 250 by passing through the second heat exchanger 263, and the other portion may be expanded in the first stage by the first expansion valve 260. A portion of the supercritical carbon dioxide expanded in the first stage may flow into the compressor 250 through the flow path connecting the first expansion valve 260 and the compressor 250, and the other portion may be expanded in the second stage by the second expansion valve 262.

When the pump 264 is disposed in the flow path connecting the first expansion valve 260 and the compressor 250, the supercritical carbon dioxide expanded in the first stage may flow into the compressor 250 through the pump 264 by passing through the first heat exchanger 261.

For primary exchange of heat, the supercritical carbon dioxide that is expanded in the first stage and that flows along the flow path connecting the first expansion valve 260 and the compressor 250 may be cooled while the supercritical carbon dioxide expanded in the second stage passes through the first heat exchanger 261 along the flow path connecting the second expansion valve 262 and the ejector 280. For secondary exchange of heat, supercritical carbon dioxide flowing from the condenser 240 to the compressor 250 may be cooled by passing through the second heat exchanger 263. After the secondary exchange of heat, the supercritical carbon dioxide expanded in the second stage may flow into the ejector 280.

Low-pressure supercritical carbon dioxide that is expanded in the second stage and that flows into the ejector 280, and high-pressure supercritical carbon dioxide heated by the ejector regenerator 270 may flow into the condenser 240 through the ejector 280, and may be cooled.

The low-pressure supercritical carbon dioxide cooled in the condenser 240 may be used to cool supercritical carbon dioxide that is expanded in the second stage and that flows into the compressor 250, and accordingly it is possible to enhance a compression efficiency of the compressor 250. Thus, it is possible to reduce energy consumption in a supercritical carbon dioxide cycle and to enhance an efficiency of the supercritical carbon dioxide cycle.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A supercritical carbon dioxide power generation system comprising a regenerator configured to heat supercritical carbon dioxide;

a turbine driven by the supercritical carbon dioxide heated by the regenerator;

a heat recoverer configured to recover heat of the supercritical carbon dioxide discharged from the turbine and to heat supercritical carbon dioxide that flows into the regenerator;

a condenser configured to cool the supercritical carbon dioxide passing through the heat recoverer;

a compressor configured to pressurize and compress the supercritical carbon dioxide discharged from the condenser;

an expansion valve configured to expand at least a portion of the supercritical carbon dioxide discharged from the condenser;

a flash tank configured to separate the expanded supercritical carbon dioxide into liquid and gas;

a heat exchanger configured to exchange heat between the gas and at least a portion of the supercritical carbon dioxide discharged from the condenser, the heat exchanger being placed between the condenser and the compressor; and an ejector configured to recover the gas passing through the heat exchanger and to move the gas to the condenser.

2. The supercritical carbon dioxide power generation system of claim 1, wherein the liquid flows into the compressor.

3. The supercritical carbon dioxide power generation system of claim 1, wherein the supercritical carbon dioxide discharged from the condenser has a quality equal to or greater than "0.5".

4. The supercritical carbon dioxide power generation system of claim 1 further comprising an ejector regenerator configured to recover heat from the regenerator and to heat at least a portion of the supercritical carbon dioxide discharged from the compressor.

5. The supercritical carbon dioxide power generation system of claim 4, wherein the supercritical carbon dioxide heated by the ejector regenerator flows into the condenser through the ejector.

6. A supercritical carbon dioxide power generation system comprising a regenerator configured to heat supercritical carbon dioxide;

a turbine driven by the supercritical carbon dioxide heated by the regenerator;

a heat recoverer configured to recover heat of the supercritical carbon dioxide discharged from the turbine and to heat supercritical carbon dioxide that flows into the regenerator;

a condenser configured to cool the supercritical carbon dioxide passing through the heat recoverer;

a compressor configured to pressurize and compress the supercritical carbon dioxide discharged from the condenser;

a first expansion valve configured to expand, in a first stage, at least a portion of the supercritical carbon dioxide discharged from the condenser;

a second expansion valve configured to expand, in a second stage, the portion of the supercritical carbon dioxide expanded in the first stage;

a first heat exchanger configured to exchange heat between the supercritical carbon dioxide expanded in the first stage and the supercritical carbon dioxide expanded in the second stage;

a second heat exchanger configured to exchange heat between at least a portion of the supercritical carbon dioxide discharged from the condenser and the supercritical carbon dioxide that is expanded in the second stage and that is discharged from the first heat exchanger, the second heat exchanger being placed between the condenser and the compressor; and an ejector configured to recover the supercritical carbon dioxide that is expanded in the second stage and that passes through the second heat exchanger, and to move the supercritical carbon dioxide to the condenser.

7. The supercritical carbon dioxide power generation system of claim 6, wherein the supercritical carbon dioxide that is expanded in the first stage and that is discharged from the first heat exchanger flows into the compressor.

8. The supercritical carbon dioxide power generation system of claim 6, wherein the supercritical carbon dioxide discharged from the condenser has a quality less than "0.5".

9. The supercritical carbon dioxide power generation system of claim 6 further comprising an ejector regenerator configured to recover heat from the regenerator and to heat at least a portion of the supercritical carbon dioxide discharged from the compressor.

10. The supercritical carbon dioxide power generation system of claim 9, wherein the supercritical carbon dioxide heated by the ejector regenerator flows into the condenser through the ejector.

* * * * *